United States Patent [19]

Maguire

[11] Patent Number: 4,514,938

[45] Date of Patent: May 7, 1985

[54] PORTABLE BUILDING STRUCTURE

[76] Inventor: Edward D. Maguire, P.O. Box 4950, San Rafael, Calif. 94903

[21] Appl. No.: 473,034

[22] Filed: Mar. 7, 1983

[51] Int. Cl.[3] ..... E04H 1/12

[52] U.S. Cl. ..... 52/79.4; 52/236.1

[58] Field of Search ..... 52/79.1, 79.4, 79.9, 52/79.5, 64, 236.1, 234; 206/519

[56] References Cited

U.S. PATENT DOCUMENTS

| | | | |
|---|---|---|---|
| 2,934,232 | 4/1960 | Pesch et al. | 206/519 |
| 3,826,229 | 7/1974 | Classe et al. | 206/519 |
| 3,905,167 | 9/1975 | Watkins | 52/79.4 |
| 4,133,148 | 1/1979 | Swenumson | 52/64 |

FOREIGN PATENT DOCUMENTS

| | | | |
|---|---|---|---|
| 1299415 | 6/1962 | France | 52/236.1 |
| 41712 | 5/1965 | German Democratic Rep. | 52/79.1 |

*Primary Examiner*—James L. Ridgill, Jr.
*Attorney, Agent, or Firm*—Melvin R. Stidham

[57] ABSTRACT

A portable building structure created by securing two frusto-pyramid building units together at their respective bases. This design enables the unassembled units to be nested for storage and transportation, thereby achieving a great savings in space. An internal foundation feature and door designs are available, and do not interfere with the nesting capability of the units.

3 Claims, 4 Drawing Figures

PORTABLE BUILDING STRUCTURE

BACKGROUND OF THE INVENTION

Numerous building structures have been designed to fill the demand for an inexpensive, storable and transportable structure. Many such designs achieve their "portability" through total assembly and disassembly of their structural components: walls, floors, roofs, etc. This requires significant preparation time and creates problems associated with the parts needed and the skill involved in assembly and disassembly. Other designs require no on-site assembly at all, and are shipped "whole". However, these designs are inherently bulky and difficult to move and store.

A further shortcoming of most present designs is their lack of a structural foundation. This requires that they be anchored to a separate external foundation, or have no foundation at all, resulting in structural instability.

OBJECTS OF THE INVENTION

It is an object of this invention to provide a portable building structure that can be easily and economically stored and transported.

It is a further object of this invention to provide a portable building structure that does not require extensive assembly or disassembly.

It is a further object of this invention to provide a portable building structure that does not require special tools, parts, or skill in assembly and disassembly.

It is a further object of this invention to provide a portable building structure that can be constructed of a variety of materials, and adaptable for broad applications.

It is a further object of this invention to provide a portable building structure that includes a self-contained foundation.

Other objects and advantages of this invention will become apparent from the description to follow, particularly when read in conjunction with the accompanying drawings.

SUMMARY OF THE INVENTION

In carrying out this invention there is provided a building structure produced from the joining of two substantially identical basic building units. Each unit is in the form of a frusto-pyramid, that is, a "floor" (or "ceiling") and outward sloping walls. For assembly, one unit is simply inverted and placed on top of the other and secured, thereby creating an enclosed structure.

The frusto-pyramid design enables the basic building units to be nested together for storage and transportation. This feature achieves a great savings in space; five disassembled structures can be stacked in the same cubic space occupied by one assembled structure.

It is contemplated that these units could be constructed of any relatively rigid material, utilizing standard fabrication techniques.

Features of the invention that complement its transportability include an internal foundation chamber in the bottom unit that can be filled with water or other material upon assembly and emptied for disassembly and transport. In addition, vertical and horizontal doors are designed to fit within the units, without affecting their stacking capability.

DESCRIPTION OF A PREFERRED EMBODIMENT

Figure 1:
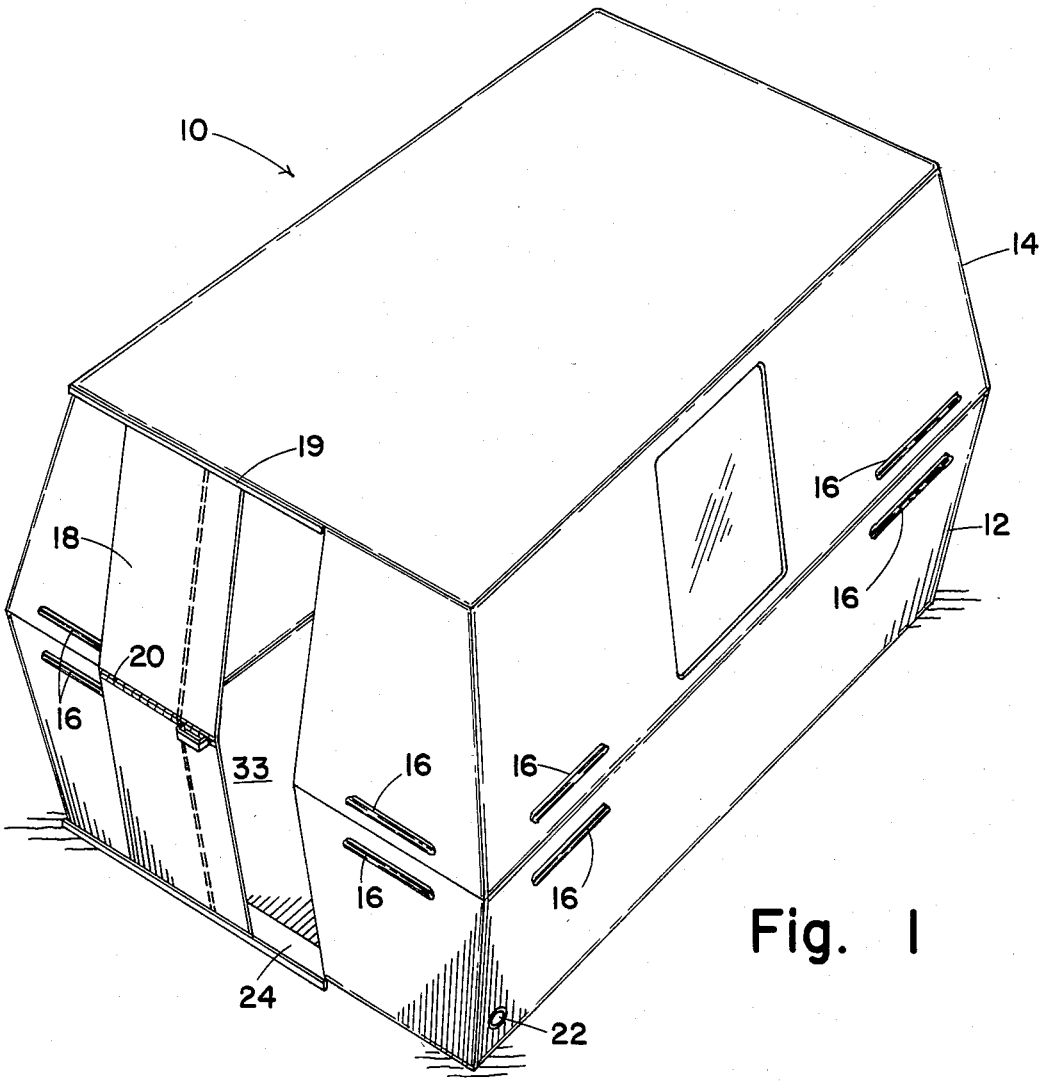
FIG. 1 is a perspective view of an assembled portable building structure, including a horizontal door design and internal foundation.
Figure 2:
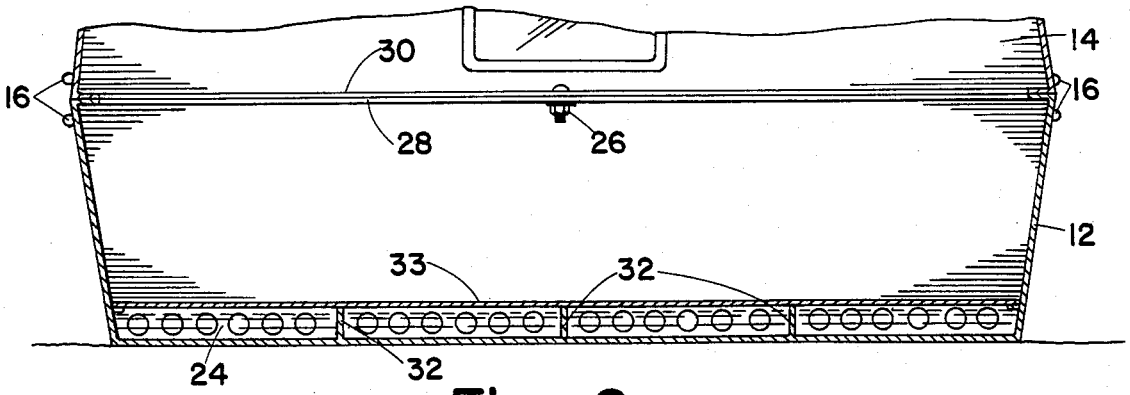
FIG. 2 is a cutaway side view, showing a fastening means and internal foundation.

Referring now to FIGS. 1 and 2 with greater particularity, there is shown an assembled portable building structure 10 including a bottom building unit 12 and top building unit 14. Incorporated into the outside walls of each unit are horizontal ridge members 16 designed to contact the flanged lip 28 or 30 of the next unit when stacked together in the nested mode, leaving room between the units for some of the components described herein, and preventing jamming of the units. A door 18 is horizontally slideable and removable from its tracks 19. The door 18 is formed in two sections interconnected by a full width hinge 20, enabling the door to be folded and laid flat in the bottom building unit 12 for ease in storage and transport. An inlet opening with closure 22 is provided for filling and draining of the liquid-type internal foundation chamber 24, which can be quickly filled with any available liquid, such as water from a garden hose, and easily drained for building disassembly.

Referring now to FIG. 2, there is shown a securing means 26 used to fasten the flanged lip 28 of bottom building unit 12 to the flanged lip 30 of top building unit 14. Vertical webs 32 support the floor 33 and also serve to baffle the liquid within the internal foundation chamber 24.

Figure 3:
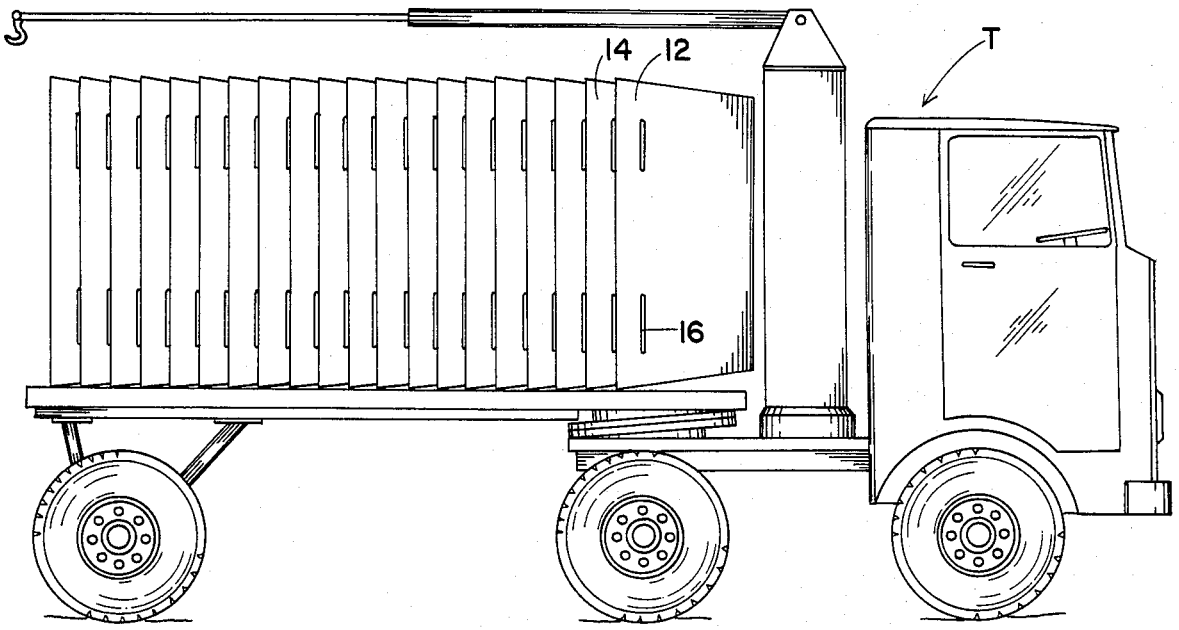
FIG. 3 is a side view of stacked units in a truck transport configuration.

Referring now to FIG. 3, there is shown a view of twenty nested typical building units 12 and 14, in a stacked configuration for transportation by truck T (when assembled, then, these twenty units would create ten complete building structures). Note that the units are designed to slide inside one another until the horizontal ridge member 16 contacts the flanged lip of the next unit.

Figure 4:
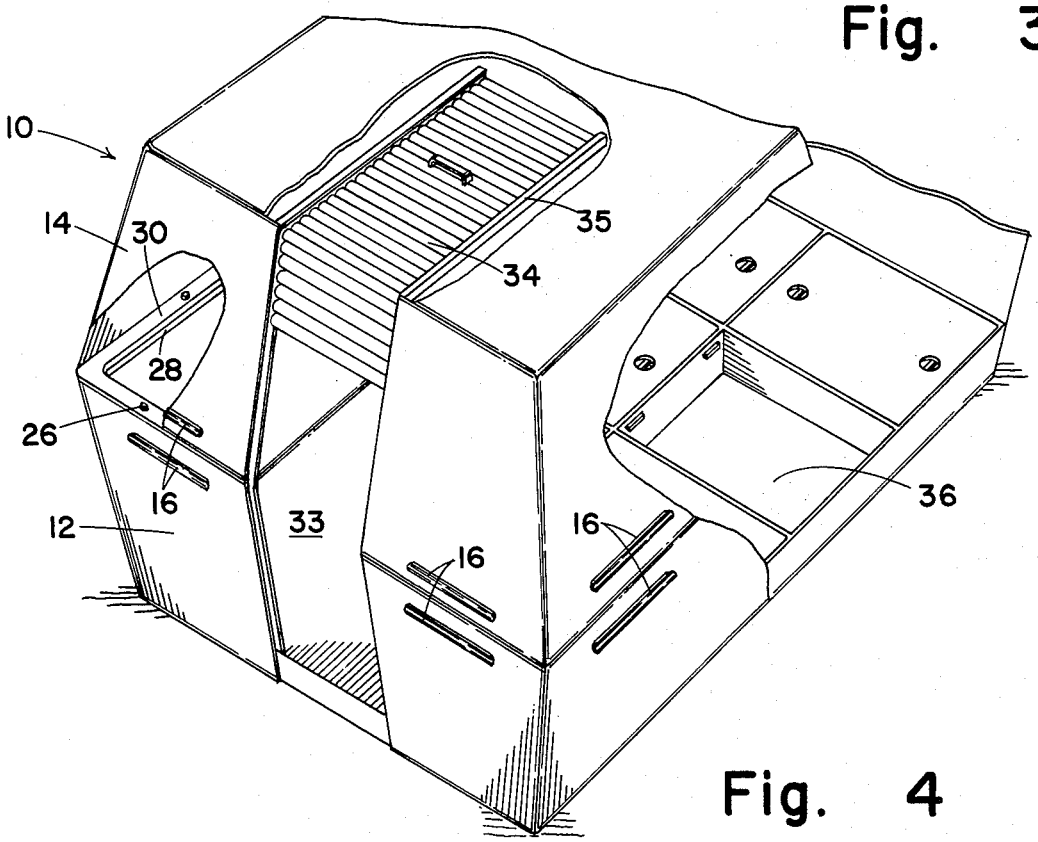
FIG. 4 is a perspective cutaway view of an assembled portable building structure showing a vertical door, fastening means and internal foundation.

Referring now to FIG. 4, there is shown an assembled portable building structure 10 consisting of bottom building unit 12 and top building unit 14. Vertical sliding door 34 is designed to be able to move up in its tracks 35 and into the top of building unit 14 for storage and transportation. Compartment-type internal foundation chamber 36, which can be filled with any heavy material, is suitable for providing a stable foundation in environments where water is unavailable.

While FIGS. 1 through 4 illustrate a four walled design, it is obvious that any number of walls, i.e., sides of the frusto-pyramid, could be used, and still retain the desired nesting capability. Indeed, the extreme case of an infinite number of walls would result in a frusto-cone shape.

While this invention has been described in conjunction with preferred embodiments thereof, it is obvious that modifications and changes therein may be made by those skilled in the art to which it pertains without departing from the spirit and scope of this invention, as defined by the claims appended hereto.

What is claimed as invention is:

1. A building structure comprising:

a pair of nestable, top and bottom frusto-pyramid shells;

each of said shells including a generally rectangular horizontal panel with generally upright side and end panels around the periphery thereof;

said side and end panels sloping outward from said horizontal panel at substantially equal angles thereto to form a frusto-pyramid;

means forming a peripheral lip including generally horizontal surface portions around the edges of said side and end panels;

a fastening means for securing together the lips of said shells in face to face engagement to form a complete enclosure, with the horizontal panels of said top and bottom shells forming roof and base panels, respectively;

a floor panel above said base panel forming a stabilizer compartment therebetween;

a fluid inlet in one of said side and end panels to introduce stabilizing fluid into said stabilizer compartment;

means forming aligned door openings through said top and bottom shells;

a slideway on said shells along said door opening; and a door slidably mounted in said slideway.

2. The building component described in claim 1 wherein said lip extends inward and including:

a horizontal ridge member carried on at least one outside wall of said shell, engageable by the lip of another shell when said shells are nested together.

3. A building comprising:

a pair of nestable, frusto-pyramid shells;

each of said shells including a generally horizontal panel with generally upright side and end panels around the periphery thereof;

said side and end panels sloping outward from said horizontal panel at substantially equal angles thereto to form a frusto-pyramid;

means forming a lip including generally horizontal surface portions around the edges of said side panels;

a fastening means for securing together the lips of said shells in face to face engagement so that the horizontal panels of said top and bottom shells form roof and base panels, respectively;

means forming aligned door openings extending through said top and bottom shells;

a horizontally disposed slideway on said shells along said door opening; and a door slidably mounted in said slideway.

* * * * *